US010051945B1

(12) United States Patent
Pomare

(10) Patent No.: US 10,051,945 B1
(45) Date of Patent: Aug. 21, 2018

(54) BULLETPROOF BACKPACK WITH SOLAR CHARGER, CONCEALED CARRY COMPARTMENT, BATON SCABBARD, AND GPS MODULE

(71) Applicant: Eduardo Pomare, Sugar Land, TX (US)

(72) Inventor: Eduardo Pomare, Sugar Land, TX (US)

( * ) Notice: Subject to any disclaimer, the term of this patent is extended or adjusted under 35 U.S.C. 154(b) by 0 days.

(21) Appl. No.: 15/817,288

(22) Filed: Nov. 20, 2017

(51) Int. Cl.

| | |
|---|---|
| ***A45F 3/02*** | (2006.01) |
| ***A45F 4/02*** | (2006.01) |
| ***F41C 33/04*** | (2006.01) |
| ***F41H 1/02*** | (2006.01) |
| *F41B 15/02* | (2006.01) |

(52) U.S. Cl.
CPC ..... *A45F 3/02* (2013.01); *A45F 4/02* (2013.01); *F41C 33/048* (2013.01); *F41H 1/02* (2013.01); *F41B 15/02* (2013.01)

(58) Field of Classification Search
CPC ..... A45F 3/04; A45F 3/02; A45F 4/02; F41C 33/048; F41H 1/02; F41B 15/02
See application file for complete search history.

(56) References Cited

U.S. PATENT DOCUMENTS

| | | | | |
|---|---|---|---|---|
| 4,830,245 | A | 5/1989 | Arikaki | |
| 5,228,609 | A * | 7/1993 | Gregory | A45F 3/02 224/617 |
| 6,419,132 | B1 * | 7/2002 | Reed | A45C 15/00 109/49.5 |
| 7,070,077 | B2 * | 7/2006 | Egart | A45F 3/02 224/608 |
| 8,410,748 | B2 * | 4/2013 | Wilson | H02J 7/0042 136/251 |
| 8,657,169 | B2 | 2/2014 | Demskey | |
| 8,998,051 | B2 | 4/2015 | Demskey | |
| 9,044,074 | B1 | 6/2015 | DeFreitas | |
| 9,144,281 | B2 | 9/2015 | Cross | |
| 9,351,557 | B2 | 5/2016 | Inouye | |
| 9,439,501 | B2 | 9/2016 | Demskey | |
| 9,730,499 | B2 * | 8/2017 | Ford | A45C 7/0059 |
| 9,854,897 | B1 * | 1/2018 | Pelkey, Jr. | A45F 3/04 |
| 9,861,145 | B2 * | 1/2018 | McIntire, Jr. | A41D 15/04 |
| 2005/0161079 | A1 | 7/2005 | Gray | |
| 2007/0170219 | A1 * | 7/2007 | Ballarta | A45F 3/04 224/645 |
| 2009/0014490 | A1 | 1/2009 | Bradley | |
| 2009/0127299 | A1 * | 5/2009 | Jamlang | A45F 3/10 224/153 |
| 2009/0282595 | A1 * | 11/2009 | Branson | F41H 1/02 2/2.5 |
| 2010/0213224 | A1 * | 8/2010 | Barr | A45C 7/0068 224/153 |

(Continued)

*Primary Examiner* — Corey Skurdal
(74) *Attorney, Agent, or Firm* — Kenneth A. Roddy

(57) ABSTRACT

A sling style bulletproof backpack having a bulletproof panel in a back section, a solar charging system including a photovoltaic cell secured to a flap of a front pocket of the backpack for recharging portable electronic devices, a concealed carry compartment on a backside, a baton scabbard on a shoulder strap of the backpack for carrying an expandable baton in a retracted condition, and a GPS tracking module disposed in the interior of the backpack.

10 Claims, 7 Drawing Sheets

(56) References Cited

U.S. PATENT DOCUMENTS

| | | | | |
|---|---|---|---|---|
| 2012/0262117 | A1* | 10/2012 | Ferber ..... | H02J 7/0047 320/111 |
| 2015/0048133 | A1 | 2/2015 | Alba et al. | |
| 2016/0161216 | A1 | 6/2016 | Ralph | |
| 2016/0360864 | A1 | 12/2016 | Drake | |
| 2017/0276457 | A1 | 9/2017 | Chapman | |

* cited by examiner

BULLETPROOF BACKPACK WITH SOLAR CHARGER, CONCEALED CARRY COMPARTMENT, BATON SCABBARD, AND GPS MODULE

BACKGROUND OF THE INVENTION

1. Field of the Invention

This invention relates generally to backpacks, and, more particularly to a bulletproof backpack having a bulletproof panel in a back section, a solar charging system including a photovoltaic cell secured to a flap of a front pocket of the backpack for recharging portable electronic devices, a concealed carry compartment on a backside, a baton scabbard on a shoulder strap of the backpack for carrying an expandable baton in a retracted condition, and a GPS tracking module disposed in the interior of the backpack.

2. Background Art

The volume of crimes committed by persons with guns is increasing continually. Police officers and members of the military have long been the victims of the occupational hazard of gunfire directed toward them during work or duty. More recently, people attending public events and students attending colleges, high schools, and junior high, have come under fire from attackers carrying and discharging firearms. Backpacks and carrying bags are used by military and law enforcement personnel to organize, store and carry various articles, however, law enforcement and security persons typically carry a baton and a handgun holstered on a waist belt when on security patrol or when called upon to apprehend a suspect.

Portable electronic devices such as laptops, tablet computers, cell phones, music players, video players, etc., have nearly become indispensable in today's society, and are typically carried everywhere by their owners and often carried in a backpack along with other articles. These portable electronic devices operate on rechargeable batteries which require being recharged regularly by connecting it to a battery charger and plugging it into a power outlet. However, finding a power outlet is not always convenient especially when traveling or away from public places.

There are several patents and published patent applications that disclose backpacks that include a solar charging system. The following are several examples.

Demskey, U.S. Pat. Nos. 8,657,169, 8,998,051, and 9,439,501, disclose a backpack including a pack portion having a top, a bottom, a front, a rear and two sides and a strap arrangement for carrying the pack portion as a backpack. The strap arrangement has a pair of carrying straps, each secured to the pack portion at about the bottom and extending upwardly along respective sides of the pack portion, and redirected at about the top of the respective sides to extend around to the rear of the pack portion, and redirected at about the top of the rear to extend downwardly for securement at about the bottom of the pack portion at the rear. The strap arrangement can redirect forces to support a load in the pack portion from the sides of the pack portion. In various embodiments the strap arrangement may include piezoelectric material for generating electricity, and a solar cell system may be included on the pack portion.

Cross, U.S. Pat. No. 9,144,281, discloses a sling bag that includes an interior compartment, an exterior receptacle compartment, a compartment wall, a set of electrical receptacles, and an openable receptacle compartment cover. The compartment wall partially defines the interior compartment and the exterior receptacle compartment and separates the interior compartment from the exterior receptacle compartment. The set of electrical receptacles is built into the compartment wall and is exposed to the exterior receptacle compartment. The openable receptacle compartment cover also at least partially defines the exterior receptacle compartment and is configured to be opened in order to expose the set of electrical receptacles to an exterior of the bag. In certain embodiments the apparatus includes a frame configured to be built into the bag defining the interior side and the exterior side and a first set of electrical receptacles rotatably attached to the frame, the first set of electrical receptacles configured to be rotated with respect to the frame between being exposed on the exterior side and being exposed on the interior side. The first set of electrical receptacles are configured to be in electrical communication with a battery which may also include a built-in solar panel configured to convert sunlight to electrical power and then provide the electrical power to the battery.

Gray, Published U.S. Patent Application 2005/0161079, discloses a system and apparatus for charging an electronic device using solar energy which, in a mobile embodiment, is incorporated into a backpack that includes a storage space for storing the electronic device and includes an interior portion and an exterior portion. A first flexible solar panel is integrated as a part of the exterior portion of the backpack and a second positional solar panel is coupled to an interior portion of the backpack. The backpack further includes a universal twelve-volt charge port electrically coupled to the first and second solar panels. The universal twelve-volt charge port is operable to actively provide solar energy to charge the electronic device while the backpack is used within a mobile environment.

There are also several patents and published patent applications that disclose bullet proof backpacks and vests. The following are several examples.

Arakaki, U.S. Pat. No. 4,830,245, discloses a backpack carrier and shield having a lightweight metal frame embedded in KEVLAR. The KEVLAR is preferably wrapped to form a plurality of layers over the metal frame and the plural layers are held together by the epoxy portion of the KEVLAR which integrally binds laminations of woven carbon-based fabric. The carrier is shaped to provide a substantially bulletproof shield and may also be used as a rifle support by placing the barrel of a rifle in a V-shaped notch provided in an upper portion of the shield.

Inouye, U.S. Pat. No. 9,351,557, discloses a survival gear backpack having a plurality of internal pockets adapted to contain items that would be needed in crisis situations while maintaining its function as a viable storage vessel for personal items usable in non-crisis situations. The backpack also includes pockets that house ballistic-protective inserts. The pockets and inserts are positioned to protect the front, rear and sides of the upper torso of a wearer.

De Freitas, et al, U.S. Pat. No. 9,044,074, discloses a rapidly deployable bulletproof vest and hood assembly, conveniently stored in a backpack, which includes a deployment assembly that provides rapid deployment and protection from flying projectiles, and a notification assembly that allows notification, GPS positioning, and real time communication with proper authorities either through an activation button in a vest pouch or remotely through a hands-free headset device.

Bradley, Published U.S. Patent Application 2009/0014490, discloses a bulletproof backpack that includes a skin that forms a pocket, a pair of shoulder straps coupled to the skin, a water-resistant bulletproof-panel pocket located on an interior surface of the skin, the bulletproof-panel pocket being suitable for holding a bulletproof panel of sufficient size and in a position to protect a wearer of the backpack from a bullet, and a removable bulletproof panel within the pocket.

Alba, et al, Published U.S. Patent Application 2015/0048133, discloses a shielded backpack for personal protection that includes a main bag forming a body of the backpack which includes a front panel and a rear panel attached to each other forming the side walls of the perimeter. The main bag also includes vertical positioning straps on the rear panel that extend from the top of the main bag towards the bottom of the main bag for being arranged on a user's back. The rear panel may also include a pocket configured to receive a rigid ballistic panel.

Drake, Published U.S. Patent Application 2016/0360864, discloses a bulletproof vest with backpack which is a combination of a vest and a bag. The vest includes a body portion and shoulder straps extending from the body portion. The body portion includes a bullet-resistant material. The bag includes an internal compartment and a closable opening leading into the internal compartment. A connector releasably attaches the bag to the body portion of the vest.

Ralph, Published U.S. Patent Application 2016/0161216, discloses a portable firearm carrier including a bag having an interior compartment and a burst zipper for accessing the interior compartment. The portable firearm carrier also includes a handgun holster mounted within the interior compartment of the bag. The handgun holster is arranged and configured to retain a handgun at a position where the handgun can be accessed through the burst zipper.

Chapman, Published U.S. Patent Application 2017/0276457, discloses a backpack for transporting articles and for ballistic protection including at least one compartment and opposing straps vertically attached to a back-facing portion of the backpack. A first compartment includes a plurality of pouches disposed on an inner surface of the first compartment to store various accessories, a second compartment immediately behind the first compartment defines a cavity sized to receive a bullet-proof material, and a third compartment is formed between the second compartment and the back-facing portion and used to store or transport various articles. The user may deploy the backpack as a ballistic protection by shifting the backpack from where the back-facing portion rests on the user's back side to where the back-facing portion rests on the user's front side. While in the ballistic protection mode, the straps remain situated on the user's shoulders so that both of the user's hands remain free to access accessories stored within the backpack and to utilize firearms if necessary.

SUMMARY OF THE INVENTION

The present invention overcomes the aforementioned problems is distinguished over the prior art in general, and these patents in particular, by a sling style bulletproof backpack for carrying articles, charging portable electronic devices, protecting a wearer from possible harm from bullets or other high velocity projectiles, and for carrying an expandable baton for defending the wearer against possible attacks or subduing an assailant.

The backpack is formed of bullet-resistant fabric material having a front panel and a back panel interconnected by left and right side panels, and a bottom panel defining an interior compartment for containing various items, the front, back, and side panels adjoined at a top end which is narrower than a bottom end of the backpack defining a generally triangular or teardrop configuration with generally rounded bottom corners. Either of the left or right side panel is adjoined to the front panel with a zipper and pull tab to provide access to the interior compartment. The back panel is of double-wall sandwiched construction formed by an inner wall and an outer wall and a protective insert formed of bullet-stopping material disposed between the inner and outer walls.

A front pocket formed of bullet-resistant fabric material is disposed on the front panel and has an open top end and a flap that overlaps, and is releasably secured over, the open top end by mating hook and loop fasteners, and a solar charging system including at least one photovoltaic cell coupled with a charging battery is secured to the flap, and connected by a cable with a controller unit adapted to be stored inside the front pocket, and a power cable coupled at one end with the controller unit circuitry has an electrical jack at an outer free end thereof configured to be connected with the charging port of a portable electronic device for recharging the electronic device.

A concealed carry compartment formed of a panel of opaque bullet-resistant fabric material is secured on an outer surface of the outer wall of the back panel and has an opening at one side adjacent to either of the left or right side panel, which is releasably connected to the outer wall with mating hook and loop fasteners, and a handgun and magazine holster secured to the outer surface of the outer wall of the back panel is disposed inside the concealed carry compartment pocket and hidden from view.

A shoulder strap assembly adjoined at an upper end to the backpack narrower top end, extends over a backside of the backpack, and is releasably connected at a lower end to either of the left or right side panel, and a baton scabbard is disposed on the shoulder strap assembly to releasably receive and hold an expandable baton in a retracted condition.

DETAILED DESCRIPTION OF THE INVENTION

Figure 1:
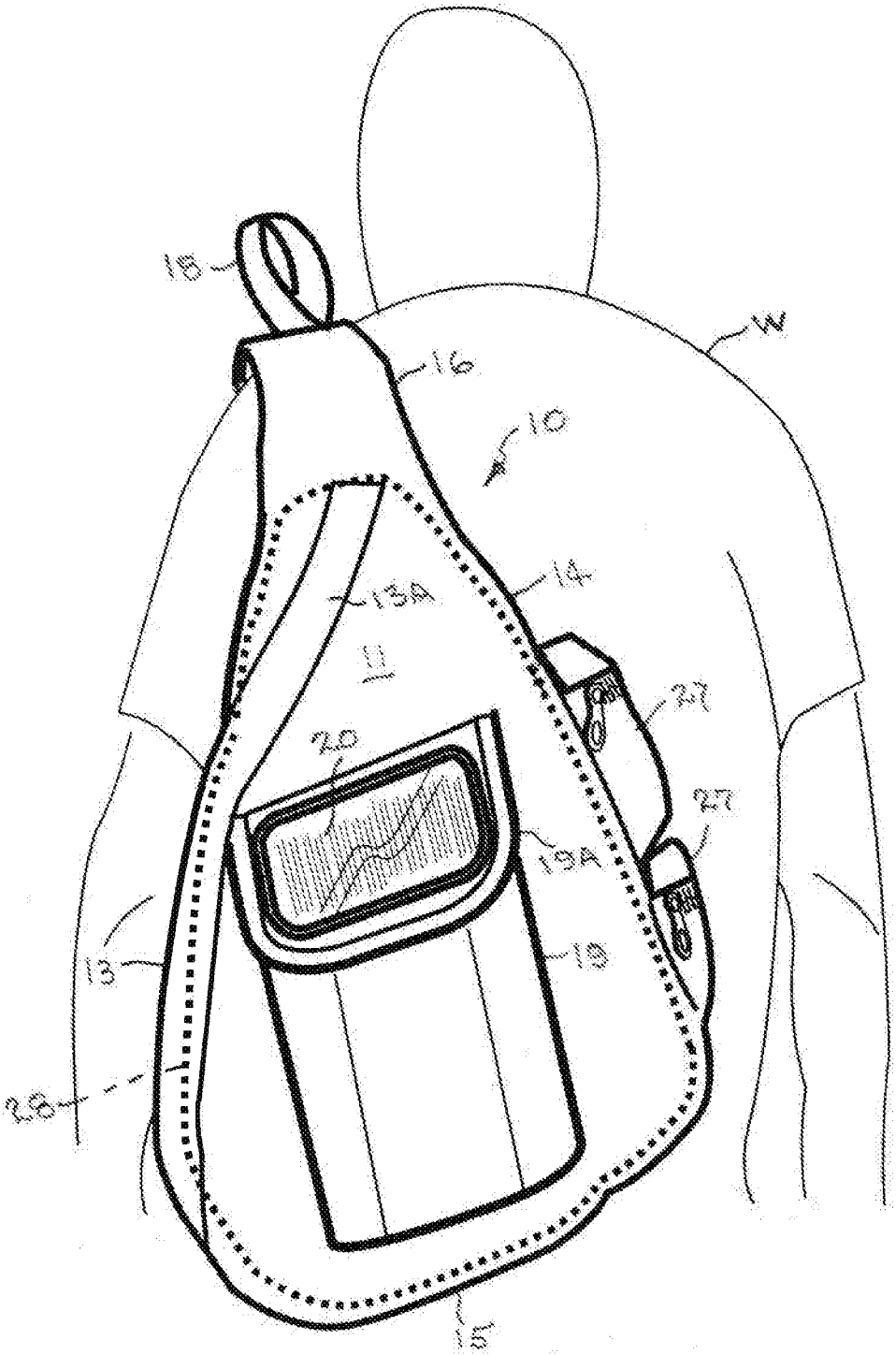
FIG. 1 is a front elevation view of the bulletproof backpack in accordance with the present invention, shown supported over the shoulder and against the wearer's back.

Referring now to FIGS. 1-7, there is shown an embodiment of the bulletproof backpack 10 in accordance with the present invention. In a preferred embodiment, but not limited thereto, the backpack 10 is of a sling style, having a generally triangular or teardrop configuration with generally rounded bottom corners which is formed by a front panel 11 and a back panel 12 that are interconnected by left and right side panels 13 and 14, respectively, and a bottom panel 15 defining an interior compartment for containing various items. As used herein, the terms "front panel" refers to the panel that faces away from the wearer W when the backpack is being worn, and "back panel" refers to the panel that that is worn against the wearer's back. The terms "left side" and "right side" refer to the side of the backpack with respect to the front panel. The terms bulletproof, bullet-stopping, and other similar terms used herein are intended to describe materials that impede or otherwise lessen the damage to one's body caused by a projectile, whether a bullet or otherwise.

The backpack 10 is constructed of a durable water repellent ballistic or bullet-resistant nylon fabric material. The front, back and side panels 11, 12, 13, and 14 are adjoined at a top end 16 which is narrower than the bottom end of the backpack. A shoulder strap assembly 17, described in more detail hereinafter, extends from the narrow top end 16 and over the backside of the backpack. A short webbing loop 18 is disposed adjacent to the juncture of the narrower top end 16 of the backpack 10 and shoulder strap assembly 17 and extends upwardly therefrom to enable the backpack to be hung from a suitable supporting structure when the backpack is not being worn.

A relatively large front pocket 19 is disposed on the front panel 11 and has a flap 19A which overlaps the open top end of the front pocket and is provided with closure means, such as mating hook and loop fasteners 19B.

Figure 2:
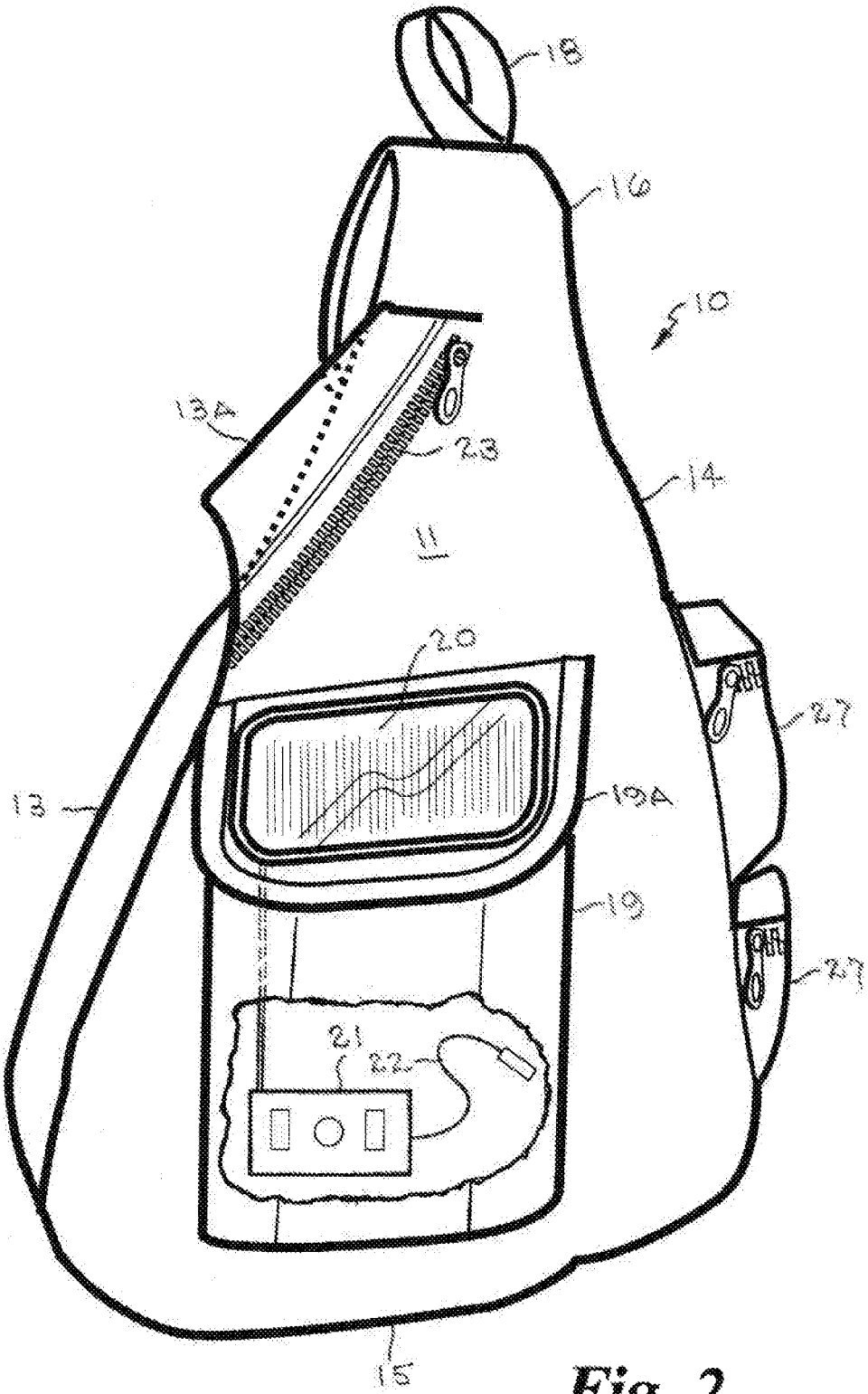
FIG. 2 is a front elevation view of the bulletproof backpack of FIG. 1, shown with the longitudinal edge of the left side panel, which normally covers an elongate zipper, slightly raised to show the zipper and pull tab, and a portion of the front pocket cut-away to show the controller unit which may be stored inside the front pocket.

A solar charging system including at least one photovoltaic cell 20 coupled with a charging battery is secured to the flap of the front pocket of the backpack, and is connected by a cable with a controller unit 21 which may be stored inside the front pocket (FIG. 2). The controller unit 21 may include a controller circuit, an ON/OFF switch, and an indicator light. A power cable 22 may be coupled at one end with the controller circuit and have an electrical jack 22A at an outer free end configured to be connected with the charging port of a portable electronic device which may also be carried in the front pocket. The solar charging system may be used for charging a variety of different portable electronic devices, such as cellular telephones, digital cameras, and other small portable electronic devices such as portable audio and video players, personal digital assistants (PDA's), and other digital devices which are equipped with a limited power supply, such as a rechargeable battery, which must be re-charged from an external source. These devices are typically provided with a charging port which receives a recharging plug for recharging the battery of the device.

The left side panel 13 is adjoined to the front panel 11 by an elongate zipper closure 23 that extends angularly between a point closely adjacent to the right hand side of the narrower top end 16 of the backpack and the left hand side of the bottom panel 15. In a preferred embodiment the longitudinal edge of the left side panel 13 has a flap portion 13A that overlaps and covers the zipper 23 and its pull tab. FIG. 2 shows the longitudinal edge of the left side panel 13, which normally covers the zipper, slightly raised to show the zipper and pull tab 23.

Figure 3:
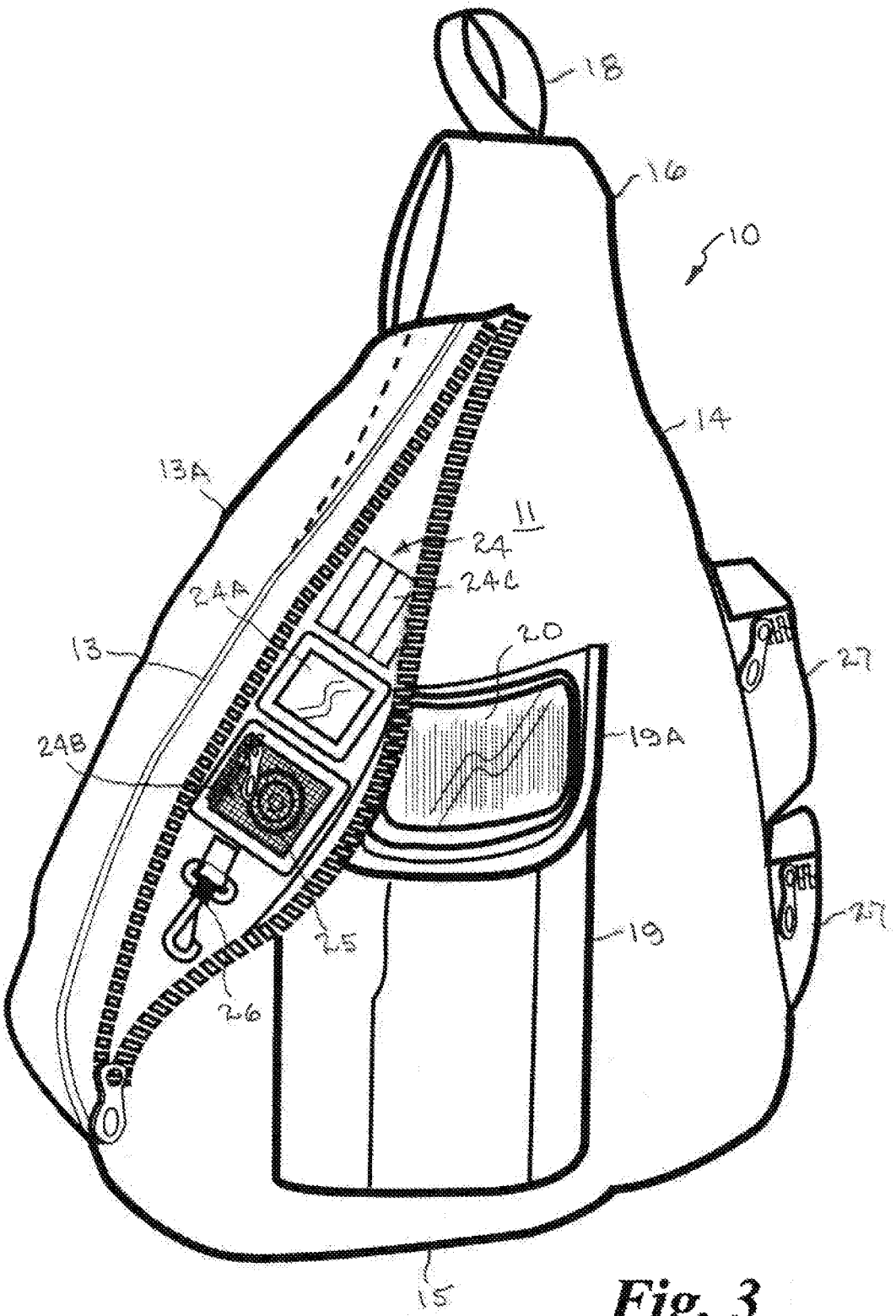
FIG. 3 is a front elevation view of the bulletproof backpack, shown with the elongate zipper open to show the interior pockets on the inner facing surface of the left side panel, and a GPS tracking module in an interior pocket.

As best seen in FIG. 3, one or more pockets 24 may be disposed on the inner facing surface of the left side panel 13. In the illustrated example, there is shown: a small pocket with a clear plastic window 24A, a mesh patch pocket with a zipper and pull tab 24B, and a multiple tube-type pocket 24C. A GPS tracking module 25 is shown disposed in the patch pocket 24B, however, it should be understood that the GPS tracking module 25 may be disposed in a hidden pocket. A swivel snap hook 26 may also be attached to the inner facing surface of the left side panel by a short webbing strap. A pair of cargo pockets 27 with zipper closures and pull tabs are disposed on the right side panel 14 in vertically spaced relation.

It should be understood that, alternatively, the right side panel 14 may be adjoined to the front panel 11 by an elongate zipper closure 23 and have a flap portion 13A that overlaps and covers the zipper 23 and its pull tab, and that the one or more pockets 24 and swivel snap hook 26 may be disposed on the inner facing surface of the right side panel 14, and the cargo pockets 27 may be disposed on exterior of the right side panel.

Figure 4:
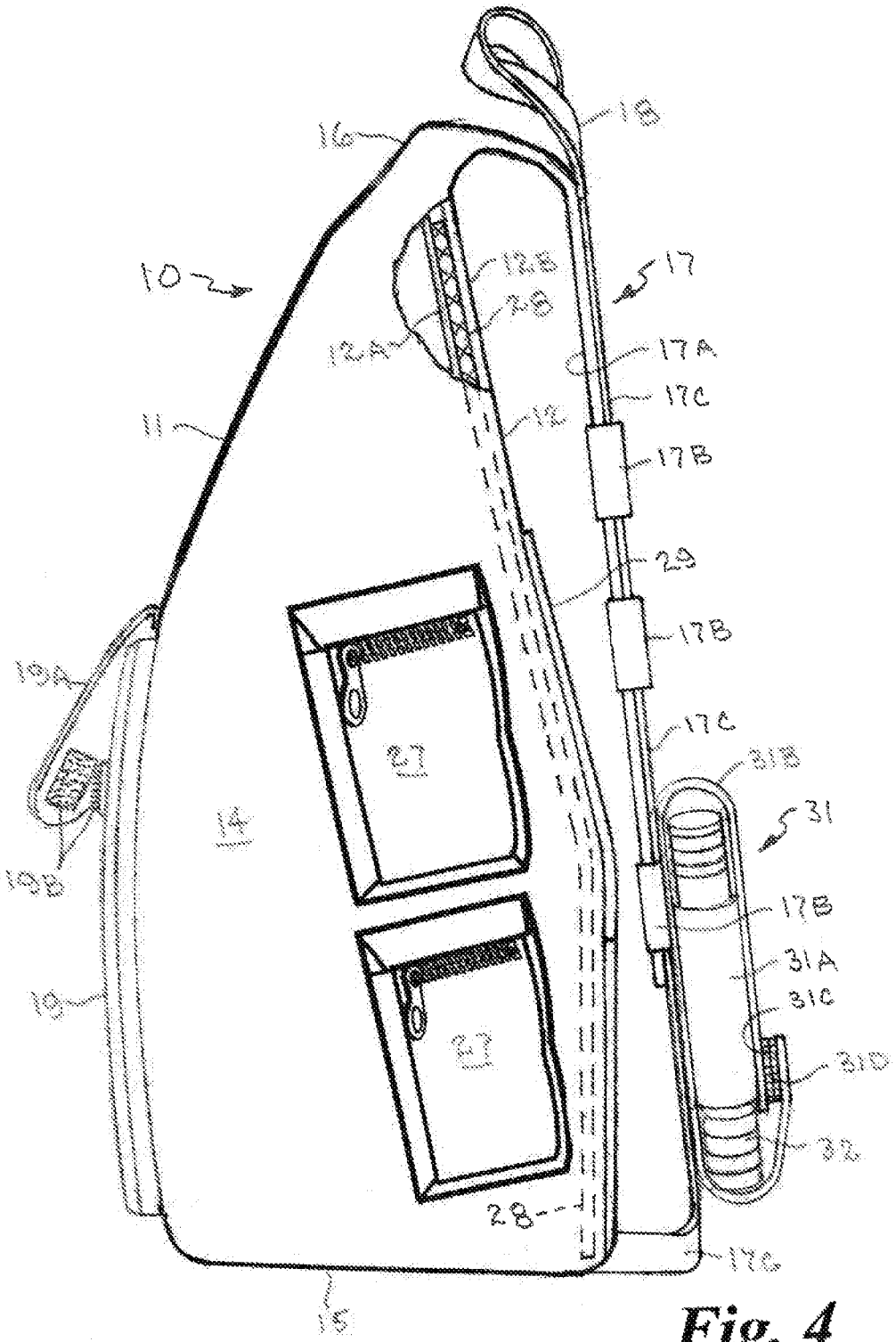
FIG. 4 is a right side view of the bulletproof backpack, showing the outer pockets on the side of the backpack, and a portion of the double-wall back panel cut away to show the protective bullet stopping insert disposed between the walls.
Figure 5:
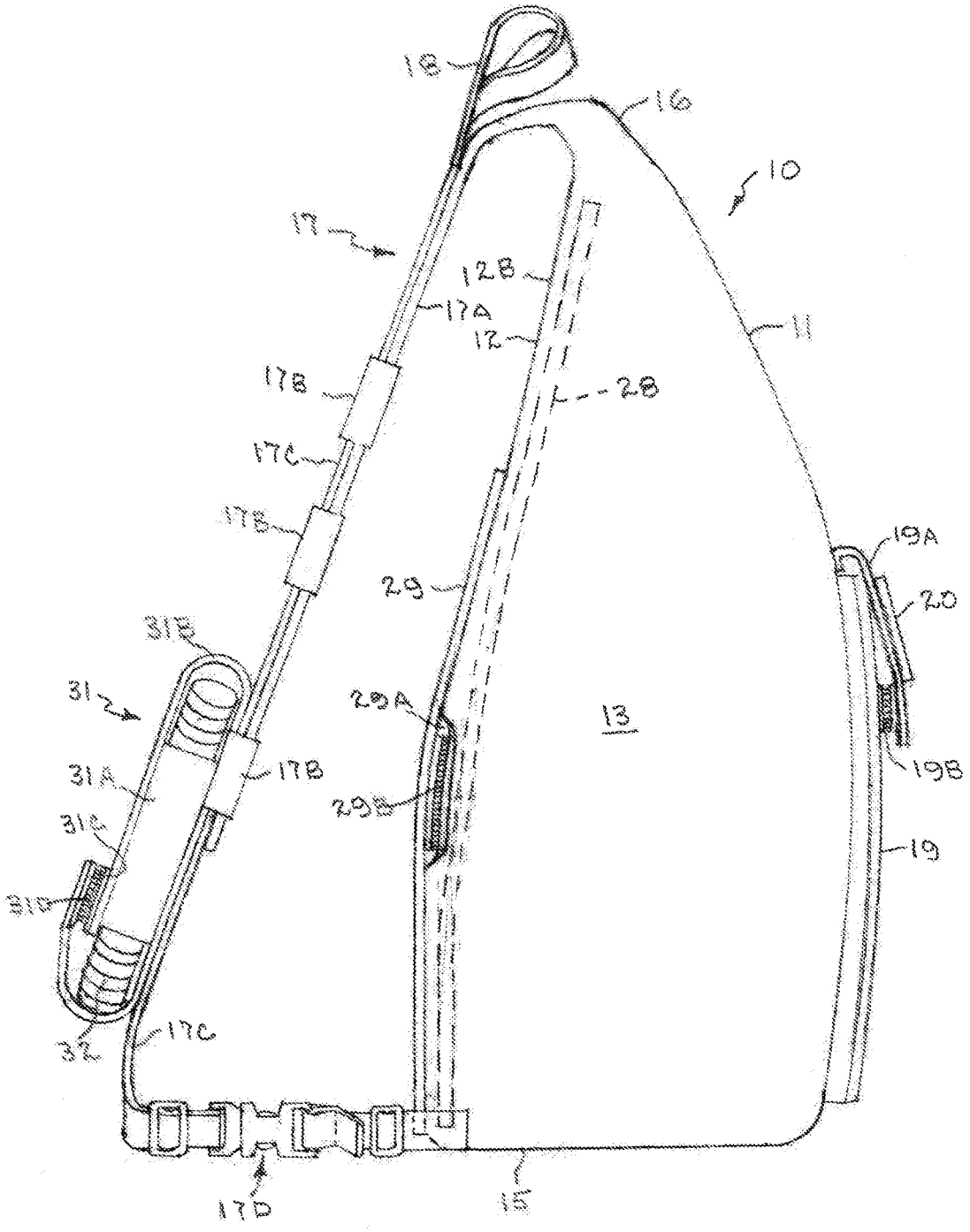
FIG. 5 is a left side view of the bulletproof backpack, showing a portion the concealed carry compartment on the back side cut away to show the hook and loop fasteners of the side opening of the compartment.

As best seen in FIGS. 4 and 5, the back panel 12 of the backpack is of double-wall sandwiched construction formed by an inner wall 12A and an outer wall 12B of the backpack material defining an envelope with a protective bullet stopping insert 28 disposed between the walls. In one embodiment, the protective insert is made of a bullet-stopping material, such as KEVLAR, which is well-known for its bullet-stopping ability. Because the insert is disposed in the interior of the backpack within the double-wall envelope, the KEVLAR insert is protected against moisture and exposure to direct sunlight, and is separate from the remainder of the interior. It should be understood that the insert 28 can be any material that stops, blocks, or otherwise impedes ballistics and other projectiles.

Figure 6:
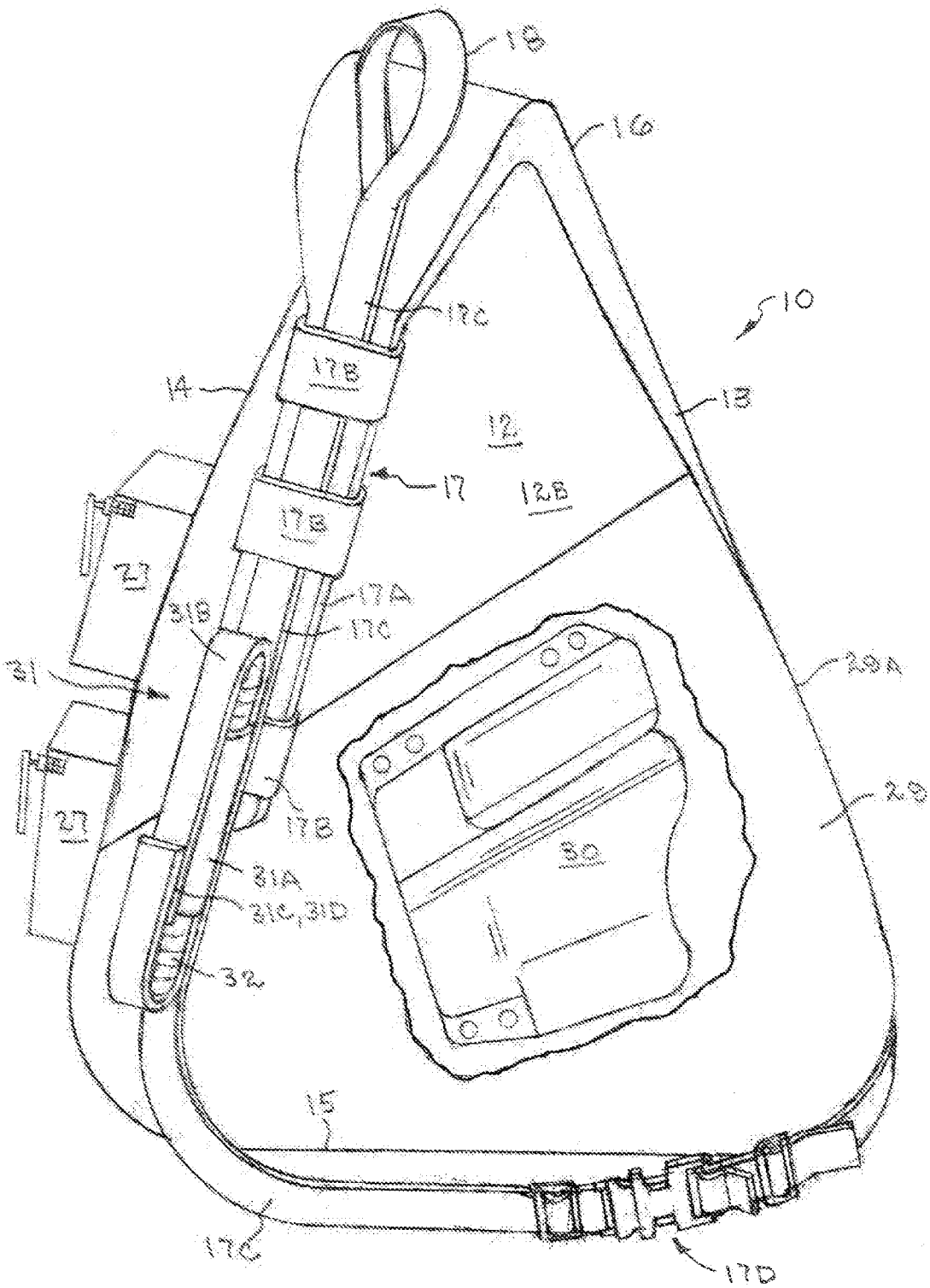
FIG. 6 is an elevation view of the back of the bulletproof backpack, showing the concealed carry compartment on the back side and the baton scabbard secured to the shoulder strap assembly with a portion of the concealed carry compartment cut away to show a handgun and magazine holster inside the compartment.

As best seen in FIGS. 5 and 6, a relatively large rear concealed carry compartment pocket 29 formed of a panel of opaque ballistic nylon material is disposed on the outer surface of the outer wall 12B of the back panel 12 and has an opening 29A at one side adjacent to the left side panel 13, which is provided with closure means such as, but not limited to, mating hook and loop fasteners 29B. It should be understood that, alternatively, the side opening 29A and hook and loop fasteners 29B may be disposed adjacent to the right side panel 14. A handgun and magazine holster 30, secured to the outer wall 12B of the back panel 12B, is disposed inside the concealed carry compartment pocket 27 and covered by the panel of opaque ballistic nylon material such they are hidden from view, but easily and quickly accessible from the side opening 29A.

As best seen in FIGS. 4-7, the shoulder strap assembly 17, described briefly above, has first wider strap member 17A formed of the same material as the backpack, and may be padded, that adjoins the narrow top end 16 of the backpack and extends a distance therefrom over the backside of the backpack. Several loops 17B formed of nylon webbing are disposed transversely along the length of the wider strap member 17A in longitudinally spaced relation along the outer surface thereof.

A second, narrower, strap member 17C formed of nylon webbing is secured at a top end to the upper end of the wider strap member 17A and extends through the loops 17B along the outer surface of the wider strap member and beyond the terminal end of the wider strap member. The bottom end of the second narrower strap member 17C is releasably connected to a bottom corner of the left side panel 13 by a releasable buckle, such a side-release buckle 17D and associated length adjustment hardware at the lower end of the second narrower strap member for adjusting the length thereof. It should be understood that, alternatively, the bottom end of the second narrower strap member 17C may be releasably connected to a bottom corner of the right side panel 14. The shoulder strap assembly 17 is worn over one shoulder and across the front of the torso of the wearer W. The wider strap member 17A provides a wide cushioned support over the wearer's shoulder and chest area and prevents discomfort that may otherwise be caused by the narrower strap member 17C alone when supporting the weight of the backpack.

A baton scabbard 31 is disposed on the second narrower strap member 17C of the shoulder strap assembly backpack for carrying an expandable baton 32 of the type which is axially expandable between retracted and extended positions. Such a baton has an enlarged tubular handle and axially aligned, successively smaller telescoping sections and an enlarged outer tip. In a closed, retracted condition, the successively smaller telescoping sections are nested within the enlarged handle.

The baton scabbard 31 is formed of a flexible nylon material, such as nylon webbing which is approximately the same width as the second narrower strap member 17C. The scabbard 31 includes an open ended tubular sheath or sleeve 31A which is secured to an elongate support/cover strap 31B which extends along the backside and over and beyond the open top and bottom ends of the tubular sheath or sleeve. The elongate support/cover strap 31B passes through the lowermost transverse loop 17B of the wider shoulder strap member and along the outer surface thereof and is secured to the second narrower webbing strap member 17C that passes through the same loop and is secured to the narrower webbing strap 17A above and below the transverse loop, such as by stitching.

The top portion of the elongate support/cover strap 31B loops over the top end of the tubular sheath or sleeve 31A in vertically spaced relation and is secured to the front surface thereof, such as by stitching, and is provided with a first hook and loop fastener element 31C on its outer facing surface. The lower portion of the elongate support/cover strap 31B loops under the bottom end of the tubular sheath or sleeve 31A in vertically spaced relation and is provided with a with a mating second element of the hook and loop fastener 31D on its inner facing surface which is releasably engageable the first fastener element.

Figure 7:
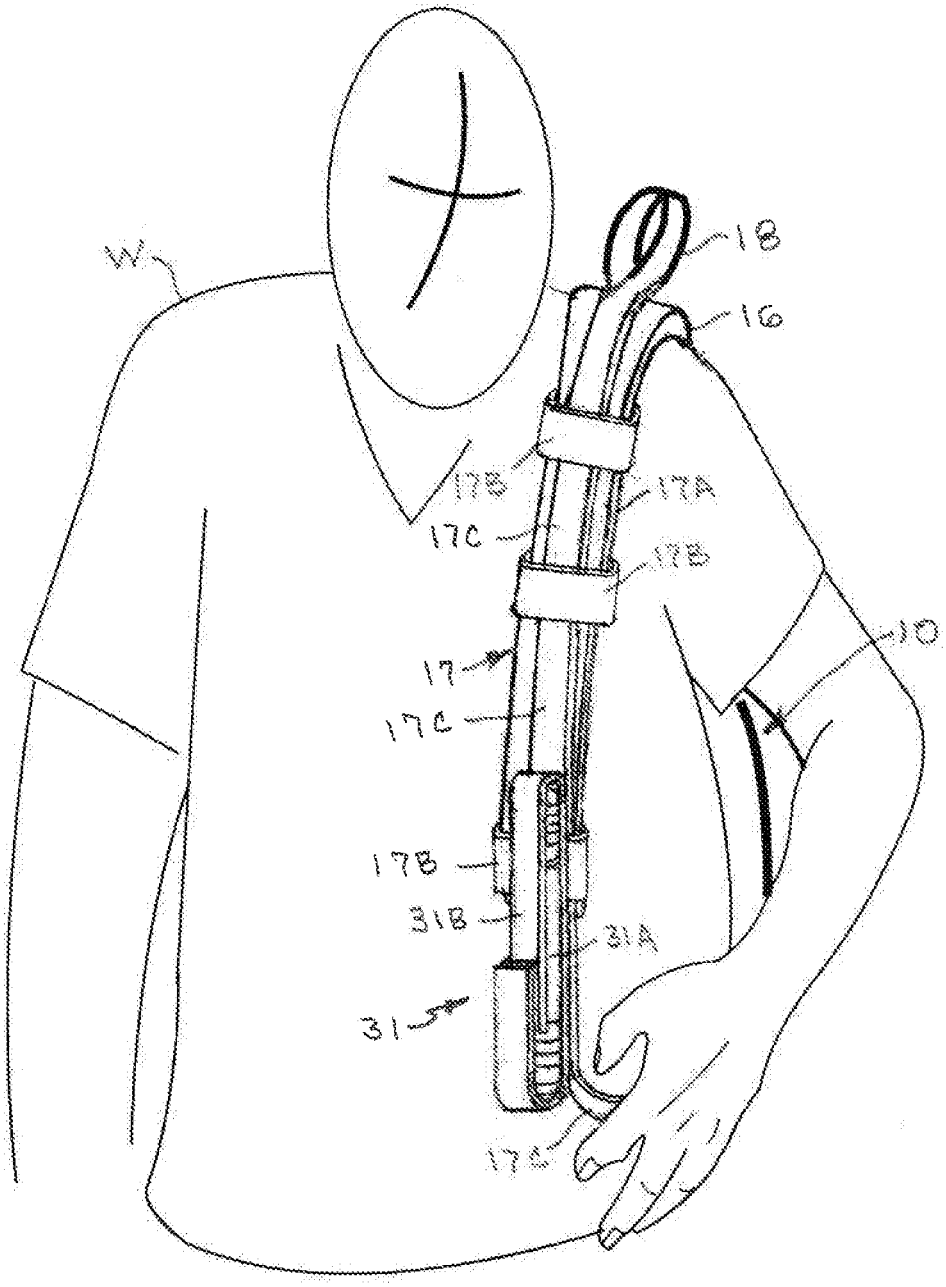
FIG. 7 is a front elevation view of the shoulder strap assembly of the bulletproof backpack shown supported over the wearer's shoulder with the baton scabbard in easy reach of the wearer's hand.

The tubular sheath or sleeve 31A is sized to slidably receive and encircle a mid-portion of the enlarged tubular handle of the baton 32 in its closed, retracted condition, and the top and bottom portions of the elongate support/cover strap 31B loop over the top and bottom ends of the closed baton. As seen in FIG. 7, when the shoulder strap assembly 17 is worn over one shoulder and across the front of the torso of the wearer W, the baton scabbard 31 is within easy reach of the wearer. The baton 32 can be quickly and easily accessed for use by pulling the overlapped lower portion of the elongate support/cover strap 31B outward to disengage the hook and loop fasteners and grasping the handle of the baton.

While the present invention has been disclosed in various preferred forms, the specific embodiments thereof as disclosed and illustrated herein are considered as illustrative only of the principles of the invention and are not to be considered in a limiting sense in interpreting the claims. The claims are intended to include all novel and non-obvious combinations and sub-combinations of the various elements, features, functions, and/or properties disclosed herein. Variations in size, materials, shape, form, function and manner of operation, assembly and use, are deemed readily apparent and obvious to one skilled in the art from this disclosure, and all equivalent relationships to those illustrated in the drawings and described in the specification are intended to be encompassed in the following claims defining the present invention.

The invention claimed is:

1. A backpack comprising:

a sling style backpack formed of bullet-resistant fabric material having a front panel and a back panel interconnected by left and right side panels, and a bottom panel defining an interior compartment for containing various items, said front, back, and side panels adjoined at a top end which is narrower than a bottom end of the backpack defining a generally triangular or teardrop configuration with generally rounded bottom corners, either of said left or right side panel adjoined to said front panel with a zipper and pull tab to provide access to said interior compartment, said back panel being of double-wall sandwiched construction formed by an inner wall and an outer wall defining an envelope, and a protective insert formed of bullet-stopping material disposed between said inner and outer walls;

a front pocket formed of bullet-resistant fabric material disposed on said front panel having an open top end and a flap that overlaps, and is releasably secured over, said open top end by mating hook and loop fasteners, a solar charging system including at least one photovoltaic cell coupled with a charging battery secured to said flap, and connected by a cable with a controller unit adapted to be stored inside said front pocket, and a power cable coupled at one end with the controller unit circuitry and having an electrical jack at an outer free end thereof configured to be connected with the charging port of a portable electronic device for recharging the electronic device;

a concealed carry compartment formed of a panel of opaque bullet-resistant fabric material secured on an outer surface of said outer wall of said back panel having an opening at one side adjacent to either of said left or right side panel, releasably connected to said outer wall with mating hook and loop fasteners, and a handgun and magazine holster secured to said outer surface of said outer wall of said back panel disposed inside said concealed carry compartment pocket and hidden from view; and a shoulder strap assembly adjoined at an upper end to said backpack narrower top end, extending over a backside of said backpack, and releasably connected at a lower end to either of said left or right side panel, and a baton scabbard disposed on said shoulder strap assembly adapted to releasably receive and hold an expandable baton in a retracted condition.

2. The backpack according to claim 1, wherein said shoulder strap assembly includes a first wider strap member formed of bullet-resistant fabric material adjoined at an upper end to said narrower top end of said backpack and extending a distance therefrom over the backside of the backpack;

a plurality of transverse loops formed of nylon webbing disposed in longitudinally spaced relation along the length of said first wider strap member;

a second, narrower, strap member formed of nylon webbing secured at an upper end to said wider strap upper end and extending along an outer surface and thereof, through said transverse loops and beyond a terminal end of said wider strap member, and having a lower end releasably connected adjacent to either of said left or right side panel by a releasable buckle and associated length adjustment hardware for adjusting the length thereof, and said baton scabbard is disposed on said second narrower strap member, and is formed of a flexible nylon webbing material which is approximately the same width as said second narrower strap member.

3. The backpack according to claim 2, wherein said baton scabbard includes an open ended tubular sleeve secured to an elongate support/cover strap that extends along the backside and over and beyond the open top and bottom ends of said tubular sleeve, said support/cover strap passing through a lowermost said transverse loop of said wider shoulder strap member and along an outer surface thereof and secured to said narrower webbing strap member that passes through said lowermost transverse loop and secured to said narrower webbing strap above and below said lowermost transverse loop;

said tubular sleeve sized to slidably receive and encircle a mid-portion of said baton in its closed, retracted condition;

a top portion of said support/cover strap looped over said top end of said tubular sleeve and top end of said closed baton and secured to a front surface thereof, and having a first hook and loop fastener element on its outer facing surface, a lower portion of said support/cover strap looped under a bottom end of said tubular sleeve and bottom end of said closed baton and having a a mating second element of the hook and loop fastener on its inner facing surface which is releasably engageable said first fastener element.

4. The backpack according to claim 2, wherein said first wider strap member of said shoulder strap assembly is padded.

5. The backpack according to claim 1, further comprising:

a GPS tracking module disposed in said interior compartment.

6. The backpack according to claim 5, wherein said GPS tracking module is disposed in one of said pockets on said inner facing surface of either of said left or right side panel.

7. The backpack according to claim 1, further comprising:

one or more pockets disposed on an inner facing surface of either of said left or right side panel selected from the group consisting of a pocket with a clear plastic window, a mesh patch pocket with a zipper and pull tab, a multiple tube-type pocket, and a hidden pocket.

8. The backpack according to claim 1, further comprising:

a swivel snap hook attached to the inner facing surface of either of said left or right side panel by a short webbing strap.

9. The backpack according to claim 1, further comprising:

a pair of cargo pockets with zipper closures and pull tabs disposed on the exterior of either of said left or right side panel in vertically spaced relation.

10. The backpack according to claim 1, further comprising:

a short webbing loop disposed adjacent to the juncture of said the narrower top end of said backpack extending upwardly therefrom to allow said backpack to be hung from a support structure when not being worn.

* * * * *